US009273944B2

(12) United States Patent
Collier

(10) Patent No.: US 9,273,944 B2
(45) Date of Patent: Mar. 1, 2016

(54) SEGMENTED MISSILE APPROACH

(75) Inventor: Nicholas Collier, Smithville, TX (US)

(73) Assignee: Innovative Defense, LLC, Smithville, TX (US)

( * ) Notice: Subject to any disclaimer, the term of this patent is extended or adjusted under 35 U.S.C. 154(b) by 204 days.

(21) Appl. No.: 13/506,226

(22) Filed: Apr. 5, 2012

(65) Prior Publication Data

US 2013/0199394 A1 Aug. 8, 2013

Related U.S. Application Data

(60) Provisional application No. 61/473,550, filed on Apr. 8, 2011.

(51) Int. Cl.
*F42B 12/58* (2006.01)
*F42B 12/18* (2006.01)
*F42B 12/62* (2006.01)

(52) U.S. Cl.
CPC ..... *F42B 12/18* (2013.01); *F42B 12/625* (2013.01)

(58) Field of Classification Search
USPC ..... 102/489, 377–379, 473–476, 438, 102/393–394
See application file for complete search history.

(56) References Cited

U.S. PATENT DOCUMENTS

| | | | | | |
|---|---|---|---|---|---|
| 2,804,823 | A * | 9/1957 | Jablansky | ..... | 102/377 |
| 3,838,644 | A * | 10/1974 | Prochnow et al. | ..... | 102/476 |
| 3,903,803 | A | 9/1975 | Losey | | |
| 3,908,933 | A | 9/1975 | Goss et al. | | |
| 4,313,380 | A * | 2/1982 | Martner et al. | ..... | 181/116 |
| 4,342,262 | A | 8/1982 | Romer et al. | | |
| 4,669,386 | A * | 6/1987 | Precoul et al. | ..... | 102/476 |
| 4,688,486 | A | 8/1987 | Hall et al. | | |
| 4,989,517 | A * | 2/1991 | Adimari et al. | ..... | 102/388 |
| 5,078,069 | A * | 1/1992 | August et al. | ..... | 114/20.1 |
| 5,088,416 | A * | 2/1992 | Sabranski | ..... | 102/517 |
| 5,235,128 | A | 8/1993 | Hardesty et al. | | |
| 5,245,927 | A * | 9/1993 | Ranes | ..... | 102/378 |
| 5,269,223 | A * | 12/1993 | Mattsson et al. | ..... | 102/210 |
| 5,988,071 | A * | 11/1999 | Taylor | ..... | 102/473 |
| 6,443,068 | B1 * | 9/2002 | Meister | ..... | 102/308 |
| 2003/0183113 | A1 * | 10/2003 | Barlow et al. | ..... | 102/476 |
| 2006/0107862 | A1 * | 5/2006 | Davis et al. | ..... | 102/216 |
| 2008/0011179 | A1 * | 1/2008 | Michel et al. | ..... | 102/275 |
| 2008/0289529 | A1 * | 11/2008 | Schilling | ..... | 102/307 |
| 2009/0211481 | A1 * | 8/2009 | Schwantes et al. | ..... | 102/275.12 |

* cited by examiner

*Primary Examiner* — Stephen M Johnson
*Assistant Examiner* — Benjamin Gomberg
(74) *Attorney, Agent, or Firm* — D. Scott Hemingway; Hemingway & Hansen, LLP

(57) ABSTRACT

This invention is a segmented missile that uses multiple circular linear shaped charge warheads deployed in tandem. Each warhead is capable of full-caliber holes and 5 to 15 charge diameters of penetration for each warhead, depending on the target material. The full-caliber hole capability allows for the warheads to travel down the hole made by the previous warhead. Each warhead is sequenced in its time of arrival at the bottom of the hole, allowing for a cumulative effect.

22 Claims, 5 Drawing Sheets

SEGMENTED MISSILE APPROACH

RELATED APPLICATION DATA

This application is related to Provisional Patent Application Ser. No. 61/473,550 filed on Apr. 8, 2011 and priority is claimed for this earlier filing under 35 U.S.C. §119(e). The Provisional Patent Application is also incorporated by reference into this application.

BACKGROUND OF INVENTION

For many years there has been a desire by the Defense Department to have a non-nuclear means of attacking underground facilities. Present technology is inadequate to this task because of the inability to penetrate deep enough in to the earth to reach the facility or to get deep enough to deliver a sufficiently large explosive quantity to generate sufficient shock in the overburden to collapse underground caverns.

Previous methods used for deep penetration explosive include a "hard-nosed" kinetic energy penetrator with explosive inside, essentially a penetrator bomb. The latest version of this device weighs 30,000 lbs. Two-thirds or more of the weight of this penetrator is parasitic, but this additional weight is required to make this device robust enough to survive its impact with and penetration of hard surfaces, such as reinforced concrete or solid rock.

Known penetrator weapons are dropped from high altitude and perhaps rocket-boosted to high velocity and slammed into the earth. The outer casing, the high explosive charge, and delicate fusing in this warhead must survive this impact and operate as designed upon reaching its maximum depth. This sledgehammer approach to penetrating deep into hard rock or multiple layers of concrete is ineffective against targets that are protected by more than 100 feet of hard rock or solid concrete.

Some effort has been made with placing a conventional shaped charge ahead of the projectile in order to create a pilot hole in the rock; however, only a small gain in depth of penetration is achievable with this method because of the very small hole diameter produced by a conventional shaped charge. The hole diameter made by a conventional shaped charge jet is small, on the order of one-tenth the diameter of the explosive charge forming the jet, and it penetrates approximately 6-8 times the diameter of the charge in steel (more in rock or masonry). A kinetic penetrator weapon could see some small advantage from this shaped charge pilot hole but will still experience tremendous ballistic shock and deceleration and will have a difficult time penetrating more than 100 feet in solid material.

This requires the projectile penetrator to have a massive outer case, which accounts for ⅔ of the weapon's weight. This earlier projectile weapon is slender; it has approximately a 10-to-1 length-to-diameter ratio, limiting the amount of high explosive onboard, as well as its orientation and coupling to the overburden. When prior art warheads are detonated, its cross-sectional "footprint" is only the diameter of the weapon, and the length of the explosive load is perpendicular to the desired shock direction.

Another type of deep penetration weapon is mostly effective against layered concrete facilities like underground basements or buildings such as Saddam Hussein's hiding place in Baghdad, which the U.S. military attacked with a smaller weapon of this kind. A BLU-57 penetrator weapon is very heavy because of the requirements of the task and requires a special aircraft to deliver it. Penetrating 80 to 100 feet is possible with a kinetic energy projectile if it has sufficient velocity, durability and mass to remain intact in its abrasive travel through the target material.

As this penetrator weapon pushes its way through the rock or concrete, the forces created radially put the target material in compression, as it has to move the material perpendicular to its direction of travel to make the hole it needs. In layered structures, the material in front of the weapon is pushed into the empty space ahead so that there is not as much resistance. In the penetration of solid materials, the material restricting the travel of the penetrator can only go lateral or aft, creating a much more difficult task than layered material. If a facility is buried in a mountain with hundreds of feet of hard rock above it, then clearly one needs a different approach.

SUMMARY OF THE INVENTION

The invention provides a means of explosively boring full caliber or greater sized holes through hardened structures such as rock, concrete, and steel to a depth of 200 feet or more in order to destroy protected enemy assets buried deep underground. The present invention can deliver a large amount of high explosive deep into the borehole above an underground facility. By coupling this large explosive load to the rock and detonating it, a 4-to-9 km/s shockwave is generated in the rock overburden. This shockwave propagates to the roof of the facility and collapses it violently.

A new combination of a programmable multi-warhead missile equipped with the new circular linear shaped charge makes this concept a reality. This invention of a segmented missile uses multiple circular linear shaped charge warheads deployed in tandem. Each warhead is capable of full-caliber holes and 5 to 15 charge diameters of penetration for each warhead, depending on the target material.

The full-caliber hole capability allows for the warheads to travel down the hole made by the previous warhead. Each warhead is sequenced in its time of arrival at the bottom of the hole, allowing for a cumulative effect. This invention addresses a greater range of target thicknesses and types and provides a more surgical means of neutralizing targets. The circular linear lined shaped charge that acts as the penetrating device can explosively bore a hole larger than the warhead diameter and penetrate several charge diameters, even through steel. This capability allows for a more precisely-placed and lighter ordnance package that can be delivered underground, facilitating less collateral damage to surrounding infrastructure but accomplishing the mission with assurance. Further, the technology disclosed here can be applied to wall breaching, vehicle destruction, mining, terraforming, and runway denial, as well as many other applications.

DETAILED DESCRIPTION OF THE PREFERRED EMBODIMENTS

Figure 1:
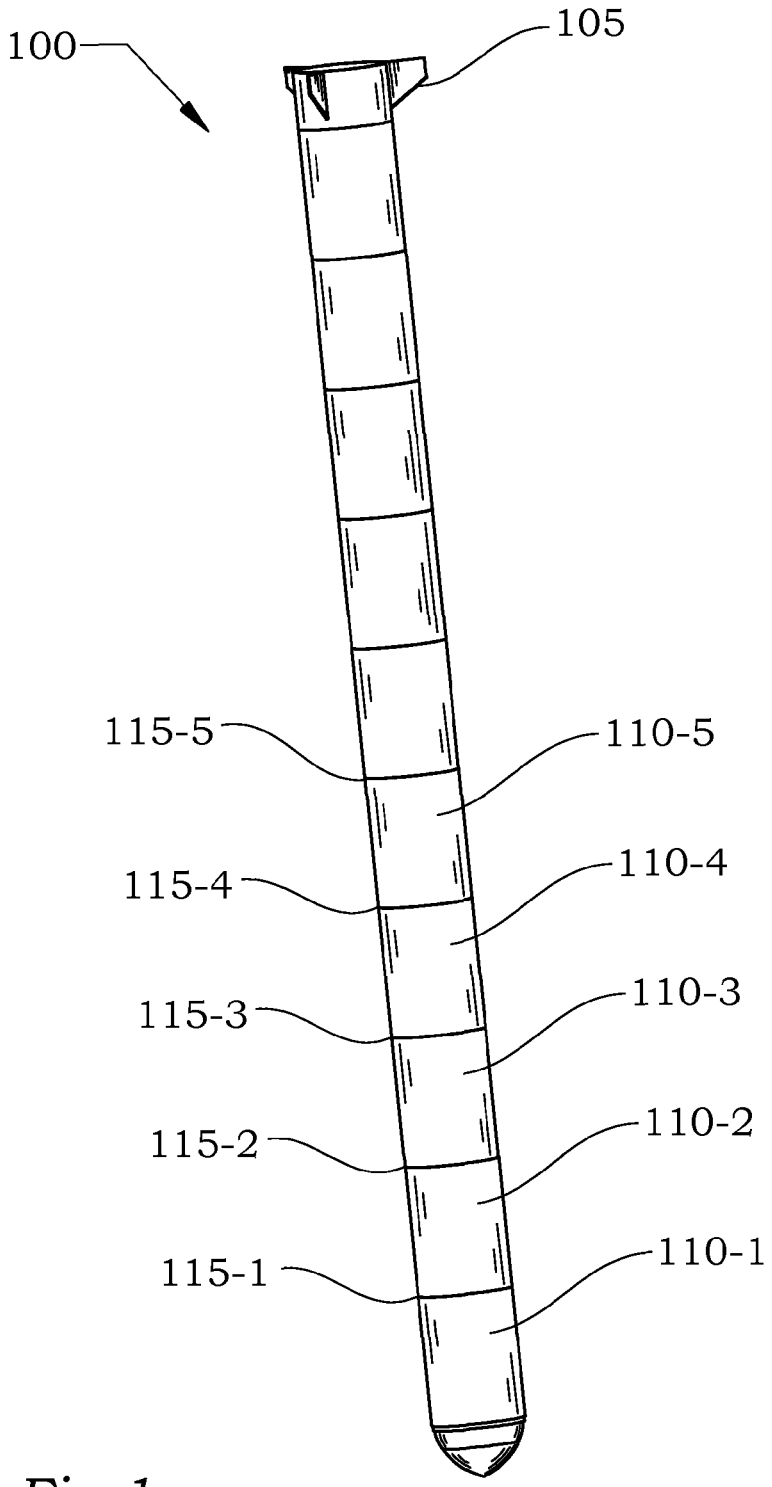
FIG. 1 is a prospective view of the segmented missile before separation.

This invention describes a system comprised of explosive shaped charges that are delivered in tandem or as separate warheads that hydro-dynamically obliterates the rock or concrete in its path, explosively cutting a hole rather than trying to force a punch-like object through it. The boring power is provided by a circular linear shaped charge that creates a hole larger than its diameter (Ref No. 61/473,550 Filed Apr. 8, 2011). By directing multiple explosive boring devices down a common hole at strategically timed intervals, their cumulative penetration allows great depths to be reached in any material. For example, by deploying a single missile containing 20 one-foot diameter warheads per missile, a 200 foot deep hole can be produced and added to in subsequent missile launches.

The missiles defined here would be much lighter than kinetic devices designed for this purpose because many of the components have hollow cavities in them and are made of low density materials. Each warhead will track precisely the unit ahead of it or follow a pre-programmed set of instructions to go to separate targets. Each of these warheads can be equipped with the circular linear shaped charge or a mix of other devices suitable to the selected target. The full-caliber hole allows a timed succession of warheads to travel down the hole, adding to the hole's depth with each warhead. This segmented missile concept, equipped with the circular linear shaped charge warheads, can produce very deep holes of large diameter in minutes through solid rock, concrete, dirt, steel, or geothermal environments. As this shaped charge jet penetrates, the material pulverized by the jet interaction flows outward from the jet tip and is forced up the wall of the hole at one half of the jet velocity 3-4 km/s (10,000 ft/s). Particles travelling at this velocity straight up against gravity in air could reach several thousand feet. Even with the added complexity of bore hole wall friction, greater depth than is currently accomplished can still be reached, and the material completely cleared from the hole.

The holes produced in this manner are straight with an insignificant amount of deviation from the axis of the original path, as determined by the angle of the longitudinal axis of the warhead segment with the horizontal plane. The high velocity of the excavated material and the straightness of the bore hole assure that debris is completely removed from the hole before the next warhead is delivered. A shaped charge of this design could penetrate a depth of up to 15 times the warhead's diameter in concrete or rock.

As an example, a one foot diameter warhead of this design could produce a clean hole larger than one foot in diameter and a depth of 8 feet in steel or 15 feet or greater in hard rock or reinforced concrete. Because of the cylindrical shape and diameter of the jet, it will cut through rebar in concrete, leaving a clean full-caliber hole through which follow-up charges can freely pass. Each successive warhead will follow the hole made by the previous warhead to its optimum depth. These warhead segments can also be guided to separate locations for attacking lighter surface targets such as ships, submarines, or any surface target.

Bridge piers, runways, and almost any structure could be collapsed in a desired fashion using the large hole capability of this device. Enclosed spaces within a building, such as biological or chemical labs or weapons storage, could be targeted directly, and a follow-through explosive, incendiary or incapacitating device could be delivered inside a chosen room in a building complex without demolishing the whole structure. Biological agents could be destroyed with an ultra high temperature follow-through.

This device is especially useful if the mission calls for holes to be drilled quickly in inaccessible areas. Military missions require holes to be drilled in a matter of minutes rather than days or months and air deliverable. There could also be an automated self-protected pallet delivery system that could be dropped in an area of interest to deliver the full-caliber hole producing shaped charges at pre-programmed intervals.

This invention can be described as a long, cylindrical, air-delivered, segmented, multiple shaped charge earth excavator capable of separating into self-guided warheads segments that propel themselves down the hole of the segment ahead of it. The shaped charge warheads in this missile are equipped with a novel liner capable of producing a hole diameter larger than the diameter of the explosive charge that collapses the liner and forms the jet. Because of this large diameter hole capability, it is possible to have a string of separated warhead segments that can follow down the hole made by the previous segment and add its penetration to the hole depth.

The time interval(s) between these warheads will allow the material excavated by the cylindrical jet of the previous shaped charge warhead to be blown out of the hole by the time the next segment enters. This separation in time also allows the shaped charge to be initiated at the optimum standoff distance from the bottom of the hole to provide the maximum penetration possible with this device. This system could be launched as a single assembly or as separate warhead segments and can be sized to the task.

In flight, the single assembly would separate into individual segments containing the specially-lined penetrating shaped charge, safe and arm device, guidance package, propulsion device, standoff, and activation mechanism. An optional add-on to each warhead is a miniaturized programmable steam-generating section on the aft of the warhead segment. This addition could produce high-pressure steam to assist with the propulsion of the warhead and the evacuation of debris as the hole grows deeper.

FIG. 1 illustrates a segmented missile 100 with guide fins 105 composed of ten warhead segments 110-1, 110-2, 110-3, 110-4, 110-5, etc. Device 100 is carried aloft by an appropriate aircraft and launched from a desired altitude or can be carried by a cruise missile. At a series of prescribed altitudes, each segment 110-1, 110-2, 110-3, 110-4, 110-5, etc. is separated at segment separation point 115-1, 115-2, 115-3, 115-4, 115-5, etc. and guided to the desired location. Each warhead segment is comprised of a circular linear shaped charge that produces a jet capable of explosively boring a full caliber hole through rock, concrete or other materials.

Figure 2:
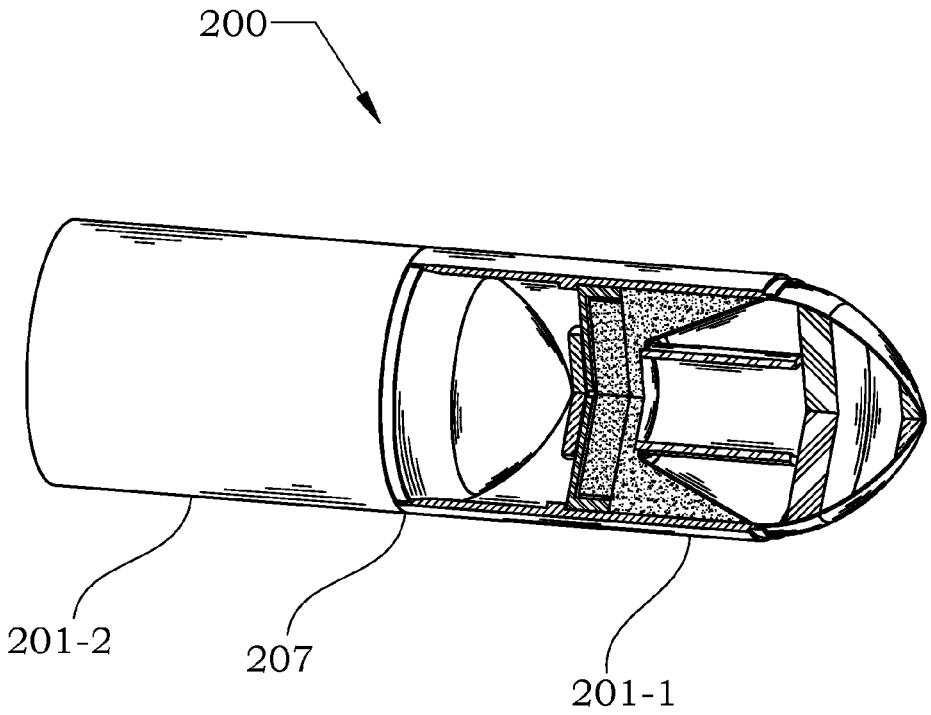
FIGS. 2 and 2*a* are cross-sections of two warhead segments.
Figure 2A:
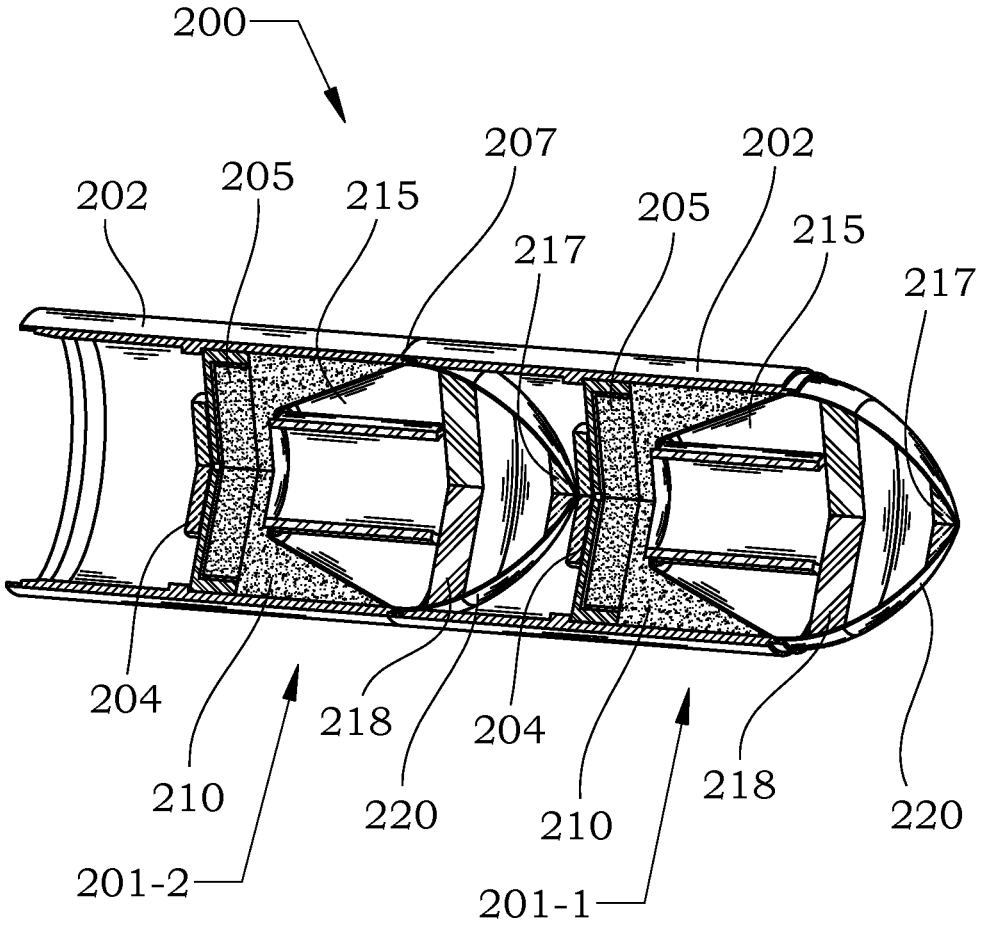

FIGS. 2 and 2*a* illustrate the assembly 200 of two warhead segments 201-1 and 201-2 connected at separation point 207. The assembly 200 of one warhead segment 201-1 or 201-2 consists of body 202, nose cone 220 with crush switch 217, precision initiation coupler 205, high explosive 210, liner 215, safe and arm device 204, guidance package 218, and propulsion system (not shown). As warhead segment 201-1 reaches the optimum standoff distance from the target face, the crush switch 217 makes contact with the target face, activating the safe and arm device 204 and detonating the high explosive 210, collapsing the liner 215 and forming the cylindrical jet that penetrates the target and removes the debris from the hole.

Figure 3:
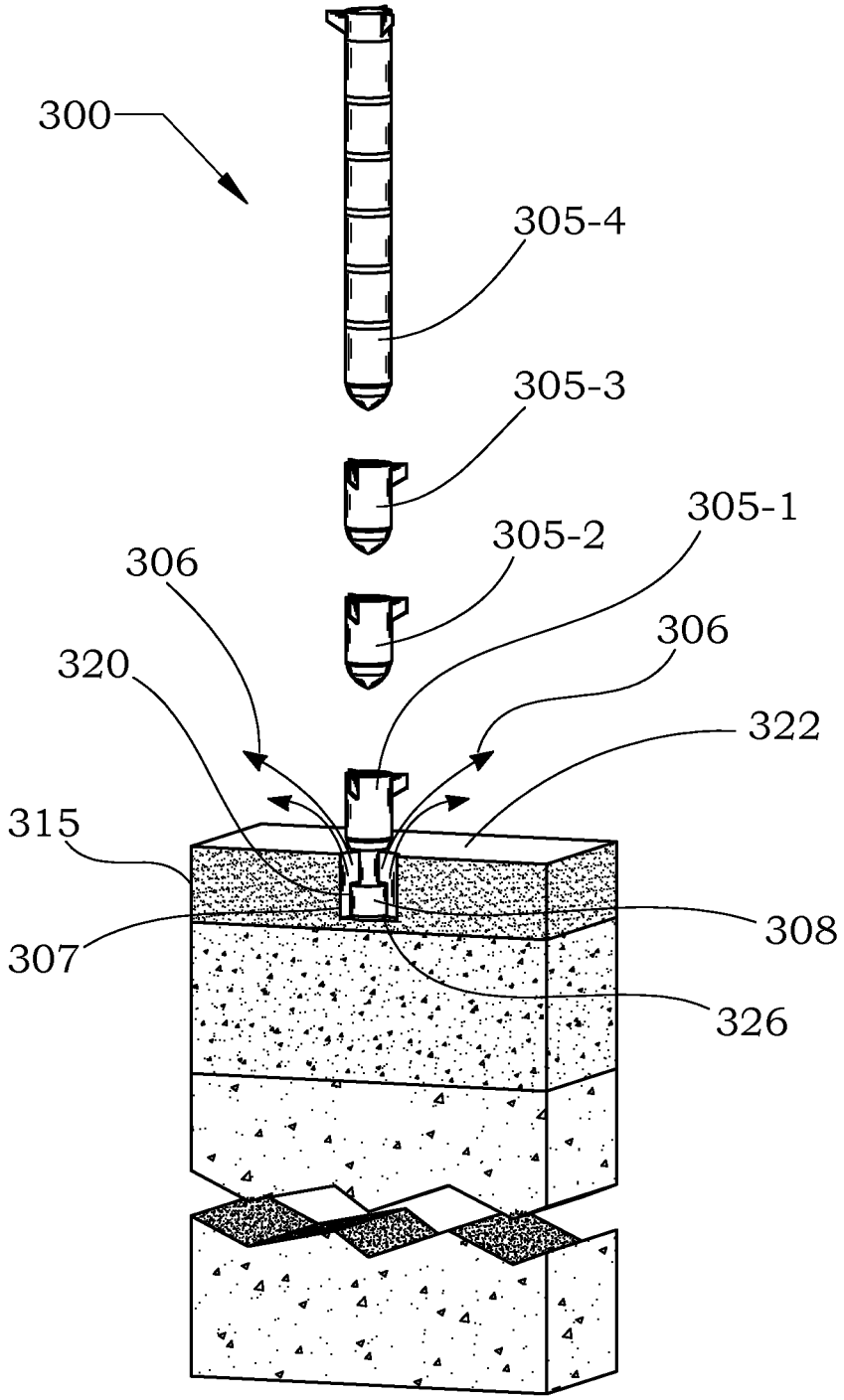
FIGS. 3 and 3*a* are diagrams of a warhead segment boring a full caliber hole.
Figure 3A:
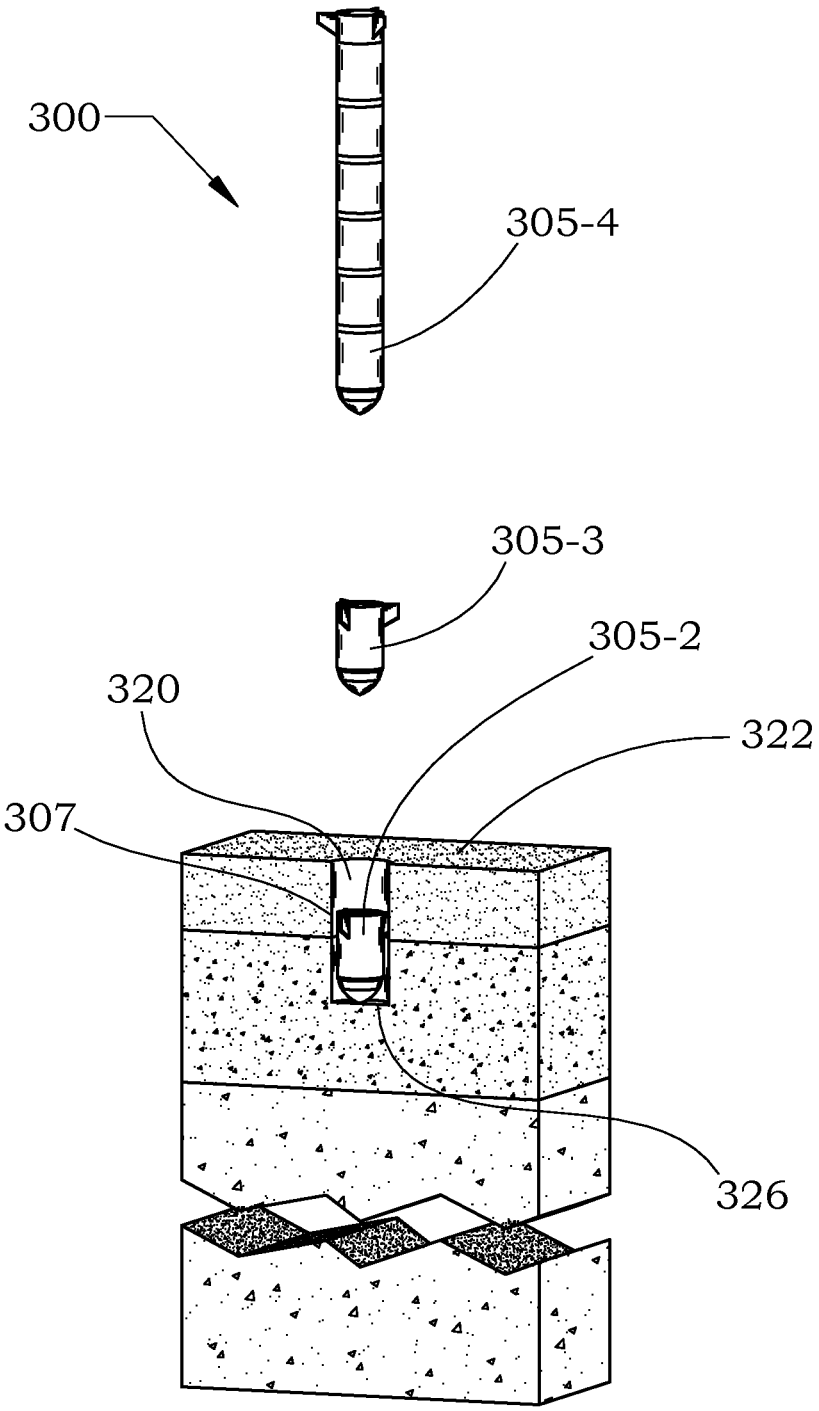

FIGS. 3 and 3*a* illustrate a segmented missile 300, consisting of warhead segments 305-1, 305-2, 305-3, 305-4, etc., with the second separated warhead segment 305-2 about to enter the borehole 320 in FIG. 3 and having entered the borehole 320 in FIG. 3*a* of target 315. In FIG. 3, the first warhead segment 305-1 has impacted the target face 322, and the cylindrical jet 308 is explosively boring a hole in the target material. The large diameter cylindrical jet 308 penetrates the target material in a very rapid and erosive manner, propelling the shattered material 306 at high velocity up the wall 307 and out of the super caliber borehole 320. Regarding FIG. 3*a*, next warhead segment 305-2 is guided down the excavated borehole 320 to the optimum standoff from the bottom face 326. This warhead segment 305-2 and each succeeding warhead segment 305-3, 305-4, etc. will add from five to fifteen charge diameters of penetration to the hole depth at super caliber diameter and propel the fragmented material to the surface, from a depth 200 feet or greater, through solid rock or concrete.

Large (10-inch plus) or small (9-inch minus) diameter holes can be explosively bored to depths of hundreds of feet in almost any material or location and from horizontal to vertical in bore orientation. This invention seeks to claim the concept of a multi-warhead missile capable of boring a full or super caliber hole to a depth of 200 feet or greater and the design of the shaped charge which makes the concept possible. Necessary future designs for this invention include a safe and arm device, guidance package, and propulsion (if needed), some of which will be filed in later patents.

The embodiment of this specific application describes a means of producing a large cavity at a depth of 200 feet or more. This cavity is for the purpose of placing a very large explosive charge deep in the earth above an enemy's underground facilities. The specific application of this invention described in the body of the text describes a system that is designed to be used entirely from the air and without the aid of ground personnel.

There could also be a parachute-deliverable automated pallet system that could deliver each warhead into the hole at the correct time interval; this could be a means for commercial use to excavate very deep holes for mining or other purposes. In the case of not penetrating into the enemy underground facility, a segment is launched and a hole is excavated to a desired depth. When the desired depth is reached, a special warhead containing a radial excavating charge is sent down the hole to clear out a chamber large enough to accommodate the required amount of explosive and provide a large enough footprint. When a large quantity of high explosive is coupled to a rock structure and detonated, a very strong shock front travels through the rock at its sonic velocity (4-9 km/s) and collapses the underground facility.

There could also be a missile or a number of missiles carrying the explosive to the cavity previously prepared. As the missile carrying the explosives reaches the bottom of the hole, the explosive will slump out over the floor area of the cavity, creating a large footprint of shock to the formation. The blast from this high explosive is tamped by the rock above it. The shock generated in the rock travels at the sound speed of the rock; when this shock encounters a void, it becomes a tension wave and causes the roof of the void to collapse. As a shock wave travels through a medium, it compresses the material within the wave length. As a discontinuity such as a void is encountered, spalling of the material takes place. The velocity of the spall is proportional to the sound speed of the rock and the shock intensity. This is all made possible by having a shaped charge warhead that can produce a hole larger than its own diameter.

Additional commercial applications exist for the invention, such as: initial Mining in remote areas, excavating initial trenches for road or rail cuts, waterways, harbors or new canals, road or airport construction in mountainous areas. In the case of commercial use, air delivery would not be a requirement of this system.

The invention claimed is:

1. A deep penetrator multiple warhead weapon comprising:

a first warhead having:

a first cylindrical body that surrounds a first high explosive charge, an angled first liner segment that extends from a first apex located toward the rear of the first cylindrical body in said first high explosive charge toward a first outer edge located adjacent to a forward portion of the first cylindrical body, said angled first liner segment connected to a first cylindrical liner segment that extends longitudinally forward from said first apex to the forward portion of the first cylindrical body;

a first nose cone surrounding a first crush switch and a first guidance package at said forward portion of said first warhead, said first crush switch activates a first safe and arm device of the first warhead when the first crush switch makes contact at or near a target to detonate the first high explosive charge thereby collapsing said first liner segments to form a forward directed first jet stream of explosive liner material in the shape of a cylinder;

said first guidance package controlling the direction of flight of said first warhead so that said first warhead makes contact at or near said target;

said first jet stream of explosive liner material creating a first borehole that is wider than the diameter of the first cylindrical body of the first warhead when the first jet stream penetrates into said target, and, a first segment separation located at a rear edge of the first cylindrical body of said first warhead;

a second warhead coupled behind the first warhead along the first segment separation, said second warhead having:

a second cylindrical body that surrounds a second high explosive charge, an angled second liner segment that extends from a second apex located toward the rear of the second cylindrical body in said second high explosive charge toward a second outer edge located adjacent to a forward portion of the second cylindrical body, said angled second liner segment connected to a second cylindrical liner segment that extends longitudinally forward from said second apex to the forward portion of the second cylindrical body;

a second nose cone surrounding a second crush switch and a second guidance package at said forward portion of said second warhead, said second crush switch activates a second safe and arm device of the second warhead when the second crush switch makes contact at or near the target to detonate the second high explosive charge thereby collapsing said second liner segments to form a forward directed second jet stream of explosive liner material in the shape of a cylinder;

said second guidance package controlling the direction of flight of said second warhead so that said second warhead may make contact at or near said target;

said second jet stream of explosive liner material creating a second borehole that is wider than the diameter of the second cylindrical body of the second warhead when the second jet stream penetrates into said target, and, a second segment separation located at a rear edge of the second cylindrical body of said second warhead;

a third warhead coupled behind the second warhead along the second segment separation, said third warhead having:

a third cylindrical body that surrounds a third high explosive charge, an angled third liner segment that extends from a third apex located toward the rear of the third cylindrical body in said third high explosive charge toward a third outer edge located adjacent to a forward portion of the third cylindrical body, said angled third liner segment connected to a third cylindrical liner segment that extends longitudinally forward from said third apex to the forward portion of the third cylindrical body;

a third nose cone surrounding a third crush switch and a third guidance package at said forward portion of said third warhead, said third crush switch activates a third safe and arm device of the third warhead when the third crush switch makes contact at or near the target to detonate the third high explosive charge thereby collapsing said third liner segments to form a forward directed third jet stream of explosive liner material in the shape of a cylinder, said third guidance package controlling the direction of flight of said third warhead so that said third warhead may make contact at or near said target;

said third jet stream of explosive liner material creating a third borehole that is wider than the diameter of the third cylindrical body of the third warhead when the third jet stream penetrates into said target, said first, second and third warheads being coupled longitudinally during transport above the target and said first, second and third warheads separating during deployment along the first and second segment separations so that each is a self-guided warhead that will be distanced from each other by one or more time intervals upon arriving at or near the target so that the first warhead will create said first borehole and each successively arriving warhead will detonate after proceeding to a bottom of the borehole created by the previously-detonated warhead.

2. The deep penetrator multiple warhead weapon of claim 1 further comprising:

one or more guide fins attached to one of said first, second and third cylindrical bodies of said first, second and third warheads, respectively.

3. The deep penetrator multiple warhead weapon of claim 1 wherein the first, second, or third warhead includes a precision initiation coupler.

4. The deep penetrator multiple warhead weapon of claim 1 wherein the first, second and third jet stream of explosive liner material is capable of explosively boring through rock or concrete located at said target.

5. The deep penetrator multiple warhead weapon of claim 1 wherein the first warhead includes one or more guide fins.

6. The deep penetrator multiple warhead weapon of claim 1 wherein the first, second, or third warhead can be calibrated to bore to a specific depth.

7. The deep penetrator multiple warhead weapon of claim 1 wherein the first, second, or third warhead causes the formation of a shockwave upon detonation.

8. A deep penetrator multiple warhead weapon comprising:

a first warhead having:

a first cylindrical body that surrounds a first high explosive charge, an angled first liner segment that extends from a first apex located toward the rear of the first cylindrical body in said first high explosive charge toward a first outer edge located adjacent to a forward portion of the first cylindrical body, said angled first liner segment connected to a first cylindrical liner segment that extends from said first apex longitudinally forward to the forward portion of the first cylindrical body;

a first nose cone surrounding a first crush switch at said forward portion of said first warhead, said first crush switch activates a first safe and arm device of the first warhead when the first crush switch makes contact at or near a target to detonate the first high explosive charge thereby collapsing said first liner segments to form a forward directed first jet stream of explosive liner material in the shape of a cylinder; and, a first segment separation located at a rear edge of the first cylindrical body of said first warhead; and, a second warhead coupled behind the first warhead along the first segment separation, said second warhead having:

a second cylindrical body that surrounds a second high explosive charge, an angled second liner segment that extends from a second apex located toward the rear of the second cylindrical body in said second high explosive charge toward a second outer edge located adjacent to a forward portion of the second cylindrical body, said angled second liner segment connected to a second cylindrical liner segment that extends from said second apex longitudinally forward to the forward portion of the second cylindrical body;

a second nose cone surrounding a second crush switch at said forward portion of said second warhead, said second crush switch activates a second safe and arm device of the second warhead when the second crush switch makes contact at or near said target to detonate the second high explosive charge thereby collapsing said second liner segments to form a forward directed second jet stream of explosive liner material in the shape of a cylinder; and, a second segment separation located at a rear edge of the second cylindrical body of said second warhead;

said first and second warheads being coupled longitudinally during transport above the target and said first and second warheads separating during deployment along the first segment separation so that each is a self-guided warhead that will be distanced from each other by one or more time intervals upon arriving at or near the target so that the first warhead will create a first borehole and the second warhead will detonate after proceeding to a bottom of the first borehole created by the previously-detonated first warhead.

9. The deep penetrator multiple warhead weapon of claim 8 further comprising:

a third warhead coupled behind the second warhead along the second segment separation, said third warhead having:

a third cylindrical body that surrounds a third high explosive charge, an angled third liner segment that extends from a third apex located toward the rear of the third cylindrical body in said third high explosive charge toward a third outer edge located adjacent to a forward portion of the third cylindrical body, said angled third liner segment connected to a third cylindrical liner segment that extends from said third apex longitudinally forward to the forward portion of the third cylindrical body;

a third nose cone surrounding a third crush switch at said forward portion of said third warhead, said third crush switch activates a third safe and arm device of the third warhead when the third crush switch makes contact at or near said target to detonate the third high explosive charge thereby collapsing said third liner segments to form a forward directed third jet stream of explosive liner material in the shape of a cylinder.

10. The deep penetrator multiple warhead weapon of claim 9 further comprising:

one or more guide fins attached to the first, the second or the third warhead.

11. The deep penetrator multiple warhead weapon of claim 9 wherein said first, second, or third warhead further comprises a guidance package controlling the direction of flight of said first, second, or third warhead so that each said warhead may make contact at or near said target.

12. The deep penetrator multiple warhead weapon of claim 9 wherein the first, second or third jet stream of explosive liner material explosively bores through rock or concrete located at said target.

13. The deep penetrator multiple warhead weapon of claim 9 wherein the first, second, or third warhead includes guide fins.

14. The deep penetrator multiple warhead weapon of claim 9 wherein the first, second, or third warhead can be calibrated to bore to a specific depth.

15. The deep penetrator multiple warhead weapon of claim 9 wherein the first, second, or third warhead causes a shockwave upon detonation.

16. The deep penetrator multiple warhead weapon of claim 9 wherein said second or third liner segments create said second or third jet streams that result in a borehole that is wider than the diameter of the first cylindrical body of the first warhead.

17. A method for producing a deep borehole using a multiple warhead weapon comprising the steps of:

providing a first warhead that has a first cylindrical body that surrounds a first high explosive charge, said first high explosive charge having an angled first liner segment that extends from a first apex located toward the rear of the first cylindrical body in said first high explosive charge toward a first outer edge located adjacent to a forward portion of the first cylindrical body, said angled first liner segment connected to a first cylindrical liner segment that extends from said first apex longitudinally forward to the forward portion of the first cylindrical body;

providing a first nose cone surrounding a first crush switch and a first guidance package at said forward portion of said first warhead, providing a first segment separation located at a rear edge of the first cylindrical body of said first warhead;

coupling a second warhead behind the first warhead along the first segment separation during transport above a target, said second warhead having a second cylindrical body that surrounds a second high explosive charge, the second high explosive charge having an angled second liner segment that extends from a second apex located toward the rear of the second cylindrical body in said second high explosive charge toward a second outer edge located adjacent to a forward portion of the second cylindrical body, providing the angled second liner segment connected to a second cylindrical liner segment that extends from said second apex longitudinally forward to the forward portion of the second cylindrical body;

providing a second nose cone surrounding a second crush switch and a second guidance package at said forward portion of said second warhead, providing a second segment separation located at a rear edge of the second cylindrical body of said second warhead;

separating said first and second warheads along the first segment separation during deployment so that each is a self-guided warhead that will be distanced from each other by one or more time intervals upon arriving at or near the target so that the first warhead will create a first borehole and said second warhead will detonate after proceeding to a bottom of said first borehole created by the previously-detonated first warhead, activating a safe and arm device of the first and second warhead when the respective crush switch on each warhead makes contact at or near the target to detonate the respective high explosive charge thereby collapsing said respective first and second liner segments to form a forward directed jet stream of explosive liner material in the shape of a cylinder;

controlling the direction of flight of said first and second warheads with the first and second guidance packages so that said first and second warheads make contact at or near said target.

18. The method of claim 17 further comprising the step of:

coupling a third warhead behind the second warhead along the second segment separation during transport above said target, said third warhead having a third cylindrical body that surrounds a third high explosive charge, said third high explosive charge having an angled third liner segment that extends from a third apex located toward the rear of the third cylindrical body in said third high explosive charge toward a third outer edge located adjacent to a forward portion of the third cylindrical body, providing the angled third liner segment connected to a third cylindrical liner segment that extends from said third apex longitudinally forward to the forward portion of the third cylindrical body; and, providing a third nose cone surrounding a third crush switch and a third guidance package at said forward portion of said third warhead.

19. The method of claim 18 further comprising the step of:

attaching one or more guide fins to one of said first, second and third cylindrical bodies of said first, second and third warheads, respectively.

20. The method of claim 19 wherein said guide fins assist with directional control of the warheads.

21. The method of claim 18 wherein the first, second, or third warhead can be calibrated to bore to a specific depth.

22. The method of claim 17 wherein said forward directed jet stream of explosive liner material explosively bores through rock or concrete.

* * * * *